United States Patent [19]

Curb

[11] 4,133,411

[45] Jan. 9, 1979

[54] EXTENSIBLE BOOM

[75] Inventor: Walter R. Curb, Dinuba, Calif.

[73] Assignee: Chamberlain Manufacturing Corporation, Elmhurst, Ill.

[21] Appl. No.: 767,828

[22] Filed: Feb. 11, 1977

[51] Int. Cl.[2] ..... B66F 11/04

[52] U.S. Cl. ..... 182/2; 212/2; 212/144; 52/118; 52/118; 212/55;144;17;9

[58] Field of Search ..... 182/2

[56] References Cited

U.S. PATENT DOCUMENTS

| | | | |
|---|---|---|---|
| 3,467,217 | 9/1969 | Zwight | 182/2 |
| 3,752,327 | 8/1973 | Olson | 212/55 |
| 4,004,695 | 1/1977 | Hockensmith | 52/118 |

*Primary Examiner*—Reinaldo P. Machado
*Attorney, Agent, or Firm*—Hill, Gross, Simpson, Van Santen, Steadman, Chiara & Simpson

[57] ABSTRACT

An extension and retraction mechanism for a three section extensible boom is disclosed utilizing an internally disposed hydraulic cylinder connected between a stationary boom section and an intermediate boom section with a cable connection located entirely interior of the boom having opposite ends anchored to opposite ends of the stationary section with the cable routed around sheaves on the moving end of the hydraulic cylinder and a base end of the intermediate boom section with a cable attachment to the base end of the inner boom section, the inner boom section being the most extensible boom section.

7 Claims, 3 Drawing Figures

EXTENSIBLE BOOM

BACKGROUND OF THE INVENTION

1. Field of the Invention

This invention relates to telescoping booms and more particularly to telescoping boom extensions and retraction systems.

2. Prior Art

Multi-section telescoping booms are well known to the art and include, for examle, three section booms having three nestled together boom sections one of which is stationary and two of which are extensible with the innermost boom section being extensible with respect to the intermediate boom section from a forward end of the intermediate boom section and the intermediate boom section being extensible with respect to the stationary boom section from a forward end of the stationary boom section.

Such devices have, in the past, included hydraulic or pneumatic cylinders which operate between the stationary boom section and one of the extensible boom sections. Although it is known to the art to attach one end of the cylinder to the stationary section and another end of the cylinder to the most extensible of the boom sections, since the amount of extension which can exist for an ordinary cylinder is less than twice its retracted length, such devices are not favored for three section booms.

In other embodiments, a plurality of hydraulic cylinders have been used with a first hydraulic cylinder connected between the stationary and the intermediate boom section and a second hydraulic cylinder connected between the intermediate and the most extensible boom section. Such constructions have a noticeable disadvantage in requiring two cylinders and further require complicated pressure hose connections to supply pressure to the separate cylinders.

In order to reduce the complexity of such devices, it has been known to utilize chains or cables connecting various boom sections. For the most part, such prior constructions using chains or cables generally mounted the chains or cables, at least in part, exteriorly of the boom section. This external mounting, in addition to giving a bad appearance left operating portions of the system exposed to the elements and unprotected from damage or abrasion during operation.

Additionally, where such chains or cables had been previously used, it was often necessary to provide a separate take-up reel controlling actuation and take-up of the cable. Thus two actuation systems were needed, one for the hydraulic system where that was used and a second for the cable system.

It would be an advance in the art to provide a system which did not rely upon any external chains or cables and which did not require any separate actuation systems but which eliminated the necessity of multiple pneumatic or hydraulic cylinders while allowing boom extension of an amount greater than twice the collapsed length of one cylinder.

SUMMARY OF THE INVENTION

My invention overcomes disadvantages inherent in the above described art. The invention is herewith disclosed in connection with a three section boom consisting of a stationary section, an intermediate extensible section and an inner, most extensible section. Hereinafter these sections will be referred to as stationary, intermediate and inner sections respectively.

Primary telescoping force is provided by an extensible member such as an hydraulic cylinder which is connected between the stationary member and the intermediate member. The hydraulic cylinder which consists of a cylinder together with telescoping piston rod is positioned interior of the inner section and has one end attached to the base end of the stationary section and a second, remote end attached to a channel member end remote from the base end. The channel member has an end adjacent the base end which is connected to the intermediate section at the base end of the intermediate section. Thus actuation of the hydraulic cylinder will cause movement of the intermediate section in or out of the stationary section.

Movement of the inner section is controlled by cables with each cable having one end anchored to the base end of the stationary section and the opposite end anchored to the stationary section adjacent its forward or free end. The cables pass from the base section outwardly towards the free end through the inner section. Adjacent the free end the cable passes around a sheave attached to the free end of the hydraulic cylinder and the returns towards the base end interior of the inner section. At the base end the cable then passes around a sheave attached to the base end of the intermediate section. The cable then extends towards the free end between the intermediate and stationary sections and is anchored adjacent the free end of the stationary section. A clamp member attached to the inner section adjacent the base end of the inner section clamps the cable to the inner section.

Although both ends of the cable remain stationarily attached to the stationary section of the boom, as the hydraulic cylinder is moved, the distance between the cable anchor on the base end of the stationary section and the sheave attached to the free end of the hydraulic cylinder increases. This increase in cable length for that stretch causes corresponding decrease in the length of the cable between the sheave around the free end of the cylinder and the clamp to the cable between the inner boom section and the cable. This causes movement of the clamp relative to both the stationary section and the intermediate boom section thereby causing extension of the inner boom section with respect to the intermediate section at the same time that the intermediate section is being extended with respect to the stationary section. The movement of the cable is such that there is synchronised movement of the boom sections. This movement is on a 1 to 1 ratio and is synchronised in both sections and is such that when the intermediate section is fully extended with respect to the base section, the inner section will be fully extended with respect to the intermediate section.

Upon reversal of the hydraulic cylinder occasioning a withdrawl of the intermediate section into the base section, the respective cable distance will again change. There will be an increase in the length of the portion of the cable between the free end of the stationary section and the sheave on the intermediate section which causes a relative decrease in the cable length between the base end of the stationary section and the sheave on the cylinder rod. This causes a relative movement of the cable stretch between sheave on the cylinder rod and the clamp between the cable and the inner boom section. Thus the inner boom section will be automatically withdrawn upon retraction of the intermediate boom section.

It can therefore be seen that my invention provides for automatic extension and retraction of the most extensible of the boom sections by means of a cable and sheave system located interiorly of the extensible boom which cable and sheave system automatically causes movement of the inner section of the boom in direct response to movement of the intermediate section of the boom with respect to the base section.

It is therefore an object of this invention to provide an improved telescoping boom assembly having at least two extensible boom sections and a stationary boom section.

It is another, more particular, object of this invention to provide an improved extensible boom system having three telescoping boom sections with an outer stationary boom section, an intermediate boom section extensible with respect to the outer boom section and an inner boom section extensible with respect to both the intermediate and outer booms whereby the inner boom section is the most extensible of the sections with movement of the inner boom controlled by a cable and sheave system located entirely interiorly of the boom assembly and with movement of the intermediate boom section controlled by a hydraulic cylinder having one end attached to the stationary boom section with a cylinder assembly intermediate portion extending through the inner boom section and terminating in a free end which has a channel member attached thereto, the channel member being positioned interior of the inner boom section and being attached to the intermediate section adjacent a base end of the intermediate section with a cable length having an end anchored to the stationary section adjacent a base end of the stationary section, the cable extending from the base end anchor interiorly of the innermost section to the free end of the cylinder thence around a sheave and back through the innermost section towards a base end thereof thence around a sheave attached adjacent a base end of the intermediate section thence between the intermediate and stationary sections to an anchor adjacent the free end of the stationary section, the cable clamped to the inner boom section and controlling extension and retraction thereof.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
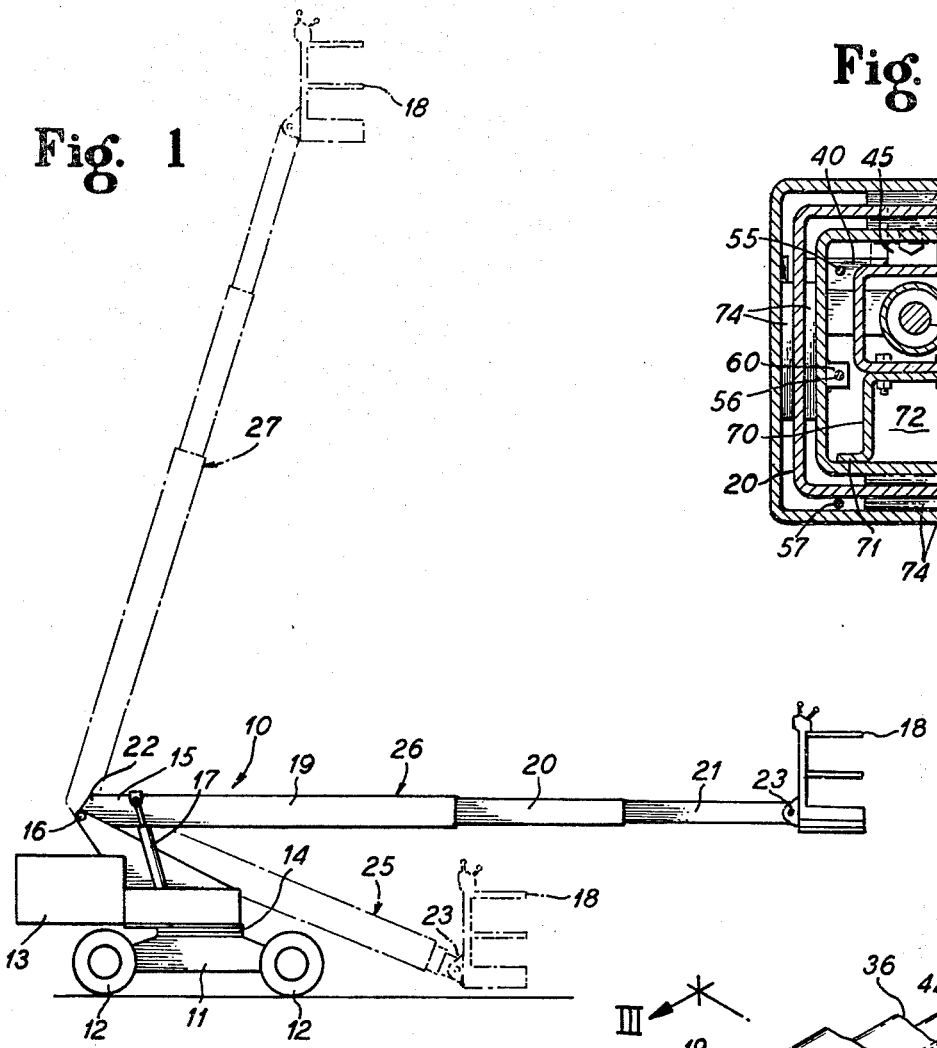
FIG. 1 is a diagrammatic, perspective view of an extensible working platform vehicle equipped with the boom assembly of this invention.

FIG. 1 illustrates an extensible platform vehicle 10 which includes a vehicle base section 11 having wheels 12 which may be articulatable and powered. A boom base 13 is carried on the vehicle base 11 through a rotating connection 14 allowing the boom base 13 to rotate in a horizontal plane with respect to the base 11. A boom assembly 15 is pivotably mounted as at 16 to the boom base 13 and may be elevated or lowered with respect thereto by means such as hydraulic jacks 17. The boom 15 has a base end portion 22 adjacent the pivot 16 and a free end portion 23 remote from the pivot. A work platform 18 may be attached to the free end portion 23 and be capable of supporting one or more workers and associated equipment.

Normally the platform 18 is attached to the free end portion 23 through an articulated connection allowing the platform to be automatically or manually leveled irrespective of the angle of inclination of the boom with respect to the horizontal. Additionally the platform 18, as well as the base 13 may be equipped with suitable controls for raising or lowering the boom, for telescoping the boom, for rotating the boom base 13 on the vehicle base 11, and if desired, for driving and steering the vehicle base 11.

Extension of the boom is accommodated through three telescoping sections including a stationary section 19 having a base end attached to the pivot 16, an intermediate section 20 telescoped in the base section 19 and an inner section 21 telescoped in the intermediate section 20. The inner section 21 thus constitutes the most extensible of the sections in that it can be telescoped outwardly the greatest distance with respect to the boom base 13.

FIG. 1 illustrates various elevations of the boom from a depressed elevation 25 through a horizontal elevation 26 to a raised elevation 27.

Figure 2:
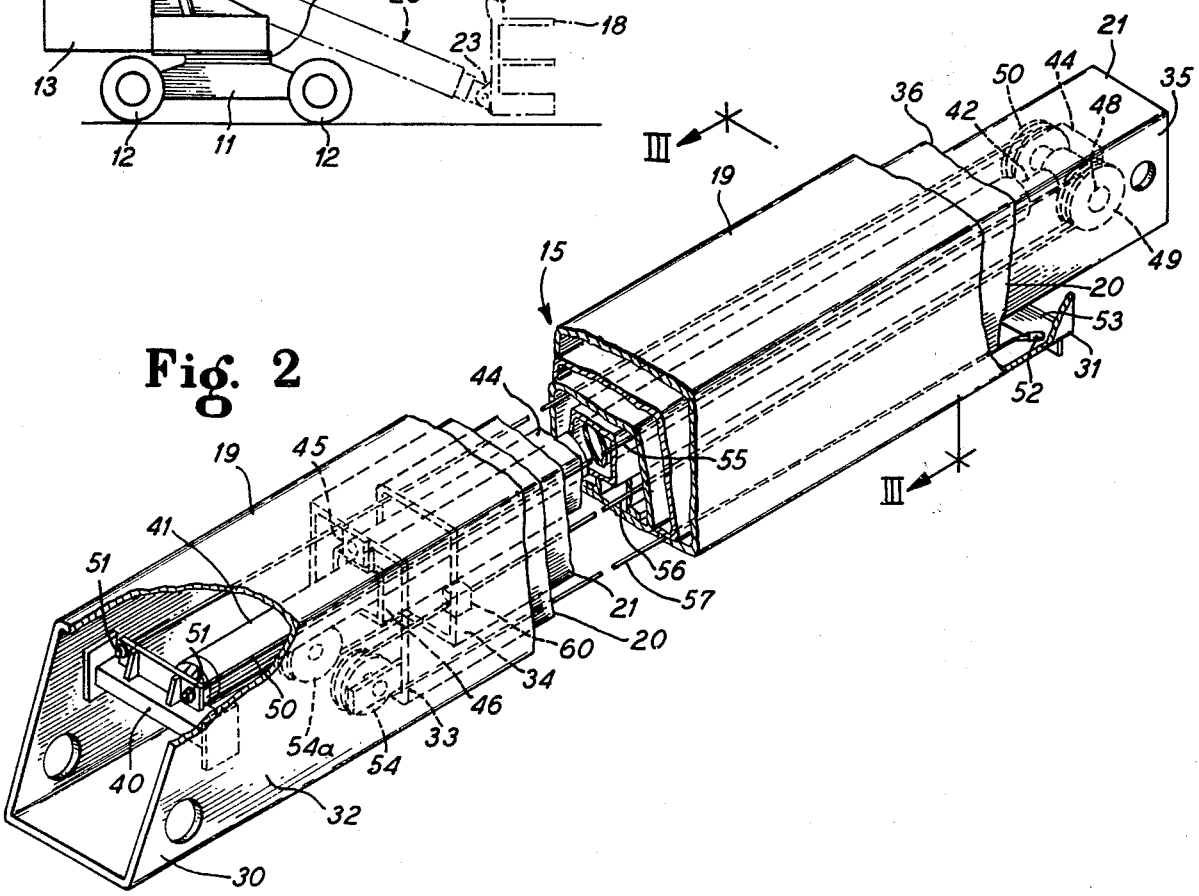
FIG. 2 is a fragmentary perspective view of the boom assembly of this invention with portions thereof broken away to show underlying portions and with interior portions illustrated by broken lines.

FIG. 2 illustrates the boom assembly 15 in greater detail showing the nestling of the inner boom section 21 in the intermediate boom section 20 which in turn is nestled in the stationary boom section 19.

The stationary boom section 19 has a base end 30 which is attached to the pivot 16 and a free end 31 remote from the base end. In the illustrated embodiment the base section, the intermediate section and the inner section are generally rectangular in cross section and are open at both longitudinal ends. When in the collapsed or retracted position, there is a space 32 between the base end 33 of the intermediate section 20 and the base end 30 of the stationary section 19. There is also a space between the base end 34 of the inner section 21 and the base end 33 of the intermediate section 20.

Conversely the free end 35 of the inner section 21 projects beyond the free end 36 of the intermediate section and the free end 31 of the stationary section. In the embodiment illustrated the free end of the intermediate section has been broken away.

Adjacent the base end 30 of the stationary section 19 a cross bar 40 spans the interior of the rectangular base section. The cross bar 40 is positioned off center of the base section and forms an anchor block for a power cylinder 41 such as a pneumatic cylinder. The power cylinder extends longitudinally of the boom assembly interior of the inner section and, in a known manner, includes a piston rod 42 which terminates interior of the inner section adjacent the free end 35 thereof but which is not affixed to the inner section. A channel member 44, which in the illustrated embodiment is a rectangular cross section hollow member surrounds the pneumatic cylinder 41 and piston rod 42 and extends from the free end of the piston rod 42 to adjacent the base end 33 of the intermediate section 20. Overlapping brackets 45 on the base end 33 of the intermediate section and on the base end 46 of the channel member 44 attach the channel member 44 to the intermediate section 20. Attachment may be by means of bolts or the like.

The channel member 44 is attached to the free end of the cylinder's piston rod as by means of an axle member 48 which passes through openings in side walls of the channel member 44 and through an eye opening in the end of the cylinder rod. Sheaves 49 and 50 may be attached to the shaft 48 exterior of the channel member 44 and interior of the inner section 21.

Thus as the hydraulic cylinder 41 is activated to extend the piston rod 42 out of the free end of the hydraulic cylinder, movement of the piston rod is transferred to movement of the channel member 44 through the shaft connection 48. Movement of the channel member 44 causes movement of the intermediate member 20 by means of the connection 45. In this manner, although the hydraulic cylinder is located interior of the inner section 21 it causes direct movement, not of the inner section 21 but of the intermediate section 20. The connection 45 with the bracket member 44 is possible due to the extension of the base end 33 of the intermediate member beyond the base end 34 of the inner member in the direction of the base end 32 of the stationary member when the boom is fully collapsed.

In order to cause movement of the inner member 21 cables 50 are provided. Each of the cables 50 has a base end 51 anchored to the cross bar 40 in the base end of the stationary member and has a free end 52 anchored to a cross bar 53 at the free end 31 of the stationary section 19. The cable 50 has a first stretch 55 which extends from the anchor end 51 to the free end of the piston rod 42 then around one of the sheaves 49, 50. The cable 50 then has an intermediate stretch 56 extending from the sheave 49, 50 back towards the base end to a sheave 54 projecting from the base end 33 of the intermediate section. A third stretch 56 of the cable 50 extends from the sheave 54 to the free end anchor 52. The first and intermediate stretches 55 and 56 project longitudinally interior of the inner section 21. The third stretch 57 extends longitudinally between the intermediate section 20 and the stationary section 19.

The intermediate stretch 56 is attached to the inner section 21 adjacent the base end thereof 34 by means of a clamp member 60.

In the preferred embodiment two cables 50 are used located on either side of the centrally disposed pneumatic cylinder 41 with one cable passing around the sheave 49 and another cable passing around the sheave 50. In this instance there are two sheaves 54 and **54*a* attached to the base end 33 of the intermediate section 20. The inner section 21 is thus firmly clamped adjacent its base end 34 to one point of the intermediate stretch 56 of each of the cables. As the sheave 49 or 50 moves with respect to the stationary section 19 by extension of the piston rod 42, the corresponding sheave 54, 54*a* will also be moved an equal distance with respect to the stationary section. This will cause a lengthening of the cable stretch 55 and a shortening of the cable stretch 57. This relative lengthening and shortening of the stretches 55 and 57 requires a movement of the cable in intermediate stretch 56 since the position of the sheaves 49, 50 and 54, 54*a* are fixed with respect to one another. Movement of the cable within stretch 56 will, because of the anchors 60 cause an equal distance movement of the inner secton 21**. The distance the inner section will be moved with respect to the intermediate section is one to one which, however, translates to a 2 to 1 movement with respect to the stationary section. In this manner as the intermediate section is moved relative to the stationary section under influence of the hydraulic cylinder, the inner section will be moved relative to the intermediate section.

The action is the same upon contraction of the system from an extended boom position by withdrawal of the piston rod 42 into the cylinder 41. In such a movement the cable stretch 55 will become shorter whereas the cable stretch 57 will become longer again requiring a corresponding movement of the cable in constant length intermediate stretch 56.

Figure 3:
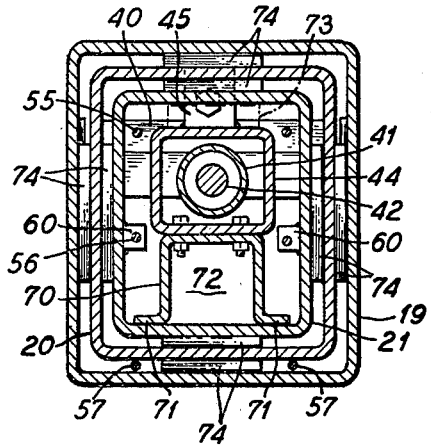
FIG. 3 is a cross section of the boom assembly of this invention taken generally along the lines III—III of FIG. 2.

In order to allow relative movement of the channel member 44 with respect to the inner section, a spacer member 70 is attached to the bracket member. The spacer member 70 is, in the preferred embodiment, U-shaped having outturned flanges 71 on the free ends of the legs of the U with the bight of the U attached to a side wall of the bracket member 44 as illustrated in FIG. 3. Thus the outturned flanges 71 form slide surfaces and the hollow interior 72 can function as a conduit for control wires and the like between the platform and the boom base 13. Wear pads 73 can be positioned between the bracket member 44 and the inner face of the inner section 21 on the opposite side of the inner section 21 from the member 70. Additionally wear pads 74 can be provided between the inner section and the intermediate section and between the intermediate section and the stationary section. Preferably the wear pads 74 are positioned on all four sides of each of the sections and in order to allow telescoping of the sections without cocking of the one section within the other, the wear pads 74 are properly disposed on the inside faces of the intermediate and stationary sections adjacent their free ends and on the outside faces of the intermediate and inner sections adjacent their base ends.

It can therefore be seen from the above that my invention provides method and means for extending the boom sections of a three section boom including a hydraulic cylinder connection between a stationary boom section and an intermediate boom section with the hydraulic cylinder positioned interior of an inner boom section and a cable connection between stationary, intermediate and inner sections and the hydraulic cylinder causing movement of the inner section relative to the intermediate and base sections such that the inner section will be automatically telescoped inwardly or outwardly of the intermediate section in direct response to movement of the intermediate section relative to the stationary section under the influence of the hydraulic system. All of the drive assemblies including the hydraulic section, the cables and associated sheaves are positioned interior of the boom assembly where they are protected from the elements and from abrasion and wear during usage.

Although I have described my invention in connection with rectangular booms and involving two cables with a hydraulic cylinder, it is to be understood that variations of this assembly can be provided including, for example, hexagonal, octagonal or the like boom sections, one, three or more cables or cables which are made up of two or more sections or other variants.

Although the teachings of my invention have herein been discussed with reference to specific theories and embodiments, it is to be understood that these are by way of illustration only and that others may wish to utilize my invention in different designs or applications.

I claim as my invention

1. An extensible boom assembly comprising nestled together telescoping boom sections each having a base end and a free end, one of said sections being a stationary section, a second of said section being a lesser extensible section and a third of said sections being a most extensible section, a hydraulic cylinder nestled within said sections, the hydraulic cylinder having a base end and a free end with the free end extensible with respect to the base end, the base end attached to the base end of one of said sections, the free end operatively coupled to the base end of the second of said sections, a cable having one end attached adjacent a base end of said one section and a second end attached adjacent a free end of said one section, said cable having a first stretch from said attachment adjacent said base end of said one section to the free end of the cylinder, a second stretch from said free end of said cylinder to a point adjacent to said base end of said second section and a third stretch passing from said point adjacent to said base end of said second section to said attachment adjacent said free end of said one section and means adjacent the base end of the third section fixedly attaching said third section to said second stretch.

2. A telescoping boom assembly comprising an outer stationary boom section, an intermediate boom section nestled in the outer stationary boom section, an inner section nestled in the intermediate section, each of said sections having free ends and base ends, a pneumatic cylinder having a base end attached interiorly of the stationary section adjacent the base end of the stationary section, the pneumatic cylinder positioned longitudinally of the assembly interior of the inner section and having a free end remote from the base end and movable relative thereto, a rigid member attached to the free end of the pneumatic cylinder, the rigid member positioned interior of the inner section extending longitudinally thereof projecting beyond the base end of the inner section terminating in an attachment end, the attachment end fixedly attached to the intermediate section adjacent the base end of the intermediate section, the inner section movable relative to the rigid member and to the intermediate section, the intermediate section movable relative to the stationary section, a cable means having a first end attached to the stationary section adjacent the base end and a second end attached to the stationary section adjacent the free end of the stationary section, the cable passing from the base end of the stationary section interiorly of the inner section around a sheave attached to the free end of the hydraulic cylinder thence back towards the base end of the stationary section interior of the inner section thence around a sheave attached to the intermediate section adjacent its base end thence between the intermediate and stationary sections to the cable second end and means attaching the inner section adjacent the base end thereof to a stretch of the cable passing between the two sheaves interiorly of the inner section.

3. A telescoping boom assembly comprising three nestled together boom sections with a hydraulic cylinder connection between a first section and a second section and spaced apart sheaves attached to respectively the second section and the hydraulic cylinder, the sheaves being in fixed spaced relation to one another, a cable having opposite ends connected to the first section with intermediate portions passing between the sheaves, an intermediate stretch of the cable extending from one sheave to the other sheave and having a point along its length fixed to the third section, movement of the first section with respect to the second section causing relative movement of the cable between the sheaves and relative movement of the cable between the sheaves causing movement of the third section.

4. A telescoping platform assembly comprising a vehicle base, a boom mount rotatably fixed to said base and rotatable in substantially a horizontal plane, a boom carried by said boom base, said boom having a base end pivoted to said boom base and a free end remote from said pivot, means for elevating the free end with respect to the boom base around said pivot, said boom comprising three nestled together substantially rectangular cross section boom sections, a first of said sections having a base therein attached to said pivot, a second of said sections telescoped within said first section and a third of said sections telescoped within said second section, said third of said sections having a free end remote from the base end of said first section, a platform attached to said free end of said third section, a hydraulic cylinder having a base end attached to the first section adjacent the base end of the first section, said hydraulic cylinder including an extensible piston rod having a free end remote from said base end of said hydraulic cylinder, said hydraulic cylinder partially nestled within said third section, a rigid hollow rectangular cross section member having a first end fixedly attached to said free end of said piston rod, said rigid member positioned interiorly of said third section and relatively movable with respect thereto, said rigid member having a second end remote from said free end of said piston rod projecting beyond a base end of the third section opposite the free end of said third section, said rigid member attached to a base end of said second section adjacent said second end of said rigid member, a sheave attached to said free end of said piston rod, a second sheave attached to said base end of said second section whereby the first and second sheaves are spaced apart a fixed distance, a cable having a first end attached to the first section adjacent the base end of the first section and a second end attached to the first section adjacent a free end of the first section remote from the base end, the cable having a first stretch extending from the base end of the first section to the sheave attached to the free end of the piston rod, the cable passing around the sheave attached to the free end of the piston rod and having a second stretch passing from the sheave at the free end of the piston to the sheave at the base end of the second section, the cable passing around the sheave at the base end of the second section, the first and second stretches of said cable having portions thereof interior of the third section, the cable having a third stretch extending from the sheave at the base end of the second section to the attachment adjacent the free end of the first section, the third stretch of the cable positioned interior of the first section and exterior of the second section, the cable at a point along the length of the second stretch attached to the third section adjacent the base end of the third section whereby movement of the second section with respect to the first section caused by telescoping of the piston rod in the pneumatic cylinder will cause relative movement of the cable within the second stretch thereby causing movement of the third section with respect to the first and second sections.

5. The device of claim 4 wherein the rigid member has a hollow channel defining member affixed thereto interior of the third section, the hollow channel defining member providing a conduit for control means between the platform and the end of the third section.

6. The device of claim 5 wherein wear pad means are positioned between the first section and the second section and between the second section and the third section.

7. The device of claim 6 wherein additional wear pad means are positioned between the rigid member and the third section.

* * * * *